US008858726B2

(12) United States Patent
Höpfl et al.

(10) Patent No.: US 8,858,726 B2
(45) Date of Patent: Oct. 14, 2014

(54) DISHWASHER WITH A VISUAL DISPLAY FACILITY

(75) Inventors: Markus Höpfl, Lauingen (DE); Ersin Isbilen, Lauingen (DE); Karlheinz Rehm, Dischingen Ortst. Trugenhofen (DE); Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 873 days.

(21) Appl. No.: 13/046,829

(22) Filed: Mar. 14, 2011

(65) Prior Publication Data

US 2011/0248609 A1 Oct. 13, 2011

(30) Foreign Application Priority Data

Apr. 7, 2010 (DE) ..... 10 2010 003 687

(51) Int. Cl.
*A47L 15/42* (2006.01)
*A47L 15/50* (2006.01)
*A47L 15/00* (2006.01)

(52) U.S. Cl.
CPC ..... *A47L 15/50* (2013.01); *A47L 2401/04* (2013.01); *A47L 15/4293* (2013.01); *A47L 2501/26* (2013.01); *A47L 2401/023* (2013.01); *A47L 15/006* (2013.01)
USPC ..... 134/56 D; 134/113; 134/29

(58) Field of Classification Search
CPC ..... A47L 15/0044; A47L 15/0055; A47L 15/006; A47L 15/0063; A47L 15/4293; A47L 15/4295; A47L 15/4297; A47L 2401/34; A47L 15/50; A47L 2401/04; A47L 2401/026; A47L 2401/26; A47L 2301/00; A47L 2301/02; A47L 2301/023; A47L 2301/026; A47L 2301/04; A47L 2301/06; A47L 2301/26; A47L 2301/34; A47L 2501/22; A47L 2501/26; A47L 2501/30; A47L 2501/36; D06F 37/203; D06F 58/203; D06F 35/003; D06F 37/225; D06F 39/003
USPC ..... 8/159, 158, 147, 149.1, 149.2; 134/1, 134/42, 6, 56 D, 113; 68/12.06, 12.04, 68/12.01, 12.27, 23.2, 3 R, 12.02, 12.16, 68/13 R, 12.05, 139, 140, 17 R, 205 R, 23 R, 68/23.1, 23.3, 5 C, 5 R
See application file for complete search history.

(56) References Cited

U.S. PATENT DOCUMENTS 6,463,940 B1 * 10/2002 Thomas et al. ..... 134/56 R
7,082,777 B2 * 8/2006 Becke et al. ..... 62/246

(Continued)

FOREIGN PATENT DOCUMENTS

DE 10017073 A1 * 10/2001 ..... A47L 15/42
EP 1582136 A1 * 10/2005 ..... A47L 15/50
WO WO2008/074590 * 6/2008 ..... A47L 15/46

OTHER PUBLICATIONS

English Machine Translation of Description of DE 10017073 A1 (Stickel, 2001).*

*Primary Examiner* — Michael Barr
*Assistant Examiner* — Irina Graf
(74) *Attorney, Agent, or Firm* — James E. Howard; Andre Pallapies

(57) ABSTRACT

A dishwasher is provided that has a door and a wash compartment that is closed off by the door. The wash compartment receives items to be treated and has a movable dish rack in which items to be cleaned are supported. The movable dish rack is moved from a treatment position in which the wash compartment is closed to an access position in which loading and unloading of dishes into the dishwasher is facilitated. The dishwasher further includes a visual display facility for visual notification of operation information and/or program information of the dishwasher. The visual display facility is assigned to the dish rack.

20 Claims, 5 Drawing Sheets

(56) References Cited

U.S. PATENT DOCUMENTS 7,110,829 B2 * 9/2006 Cunningham et al. ..... 700/2
7,516,746 B1 * 4/2009 Davis ..... 134/113
7,524,380 B1 * 4/2009 Duri et al. ..... 134/18
2007/0119478 A1 * 5/2007 King et al. ..... 134/18
2009/0016004 A1 * 1/2009 McCoy ..... 361/681

* cited by examiner

DISHWASHER WITH A VISUAL DISPLAY FACILITY

BACKGROUND OF THE INVENTION

The invention relates to a dishwasher, in particular a household dishwasher, having a wash compartment that can in particular be closed off by a door for receiving items to be treated, the wash compartment being provided with at least one movable wash rack, in which items to be cleaned can be supported and which can be moved from a treatment position in which the wash compartment can be closed to an access position facilitating loading and unloading, the dishwasher having at least one display facility for the visual notification of dishwasher operation and/or program information.

In the case of dishwashers different operation and program parameters of the dishwasher are generally detected and also output at least partially by way of a display facility. In the case in particular of what are known as fully integrated dishwashers, where a closed flat panel is provided on the outside of the door closing off the wash compartment, the display facility is difficult to see when the door is open, as it is then located in the upper end edge region of the door, which faces upward when the front pivoting door is closed and when the door is pivoted downward it is a long way down and facing roughly horizontally forward.

The at least one dish rack of the respective dishwasher can frequently be displaced forward on side rails by way of rollers into an access position with the front door opened for both loading and unloading the wash compartment and when full can be pushed backward in proximity to a rear wall of the wash compartment into a treatment or processing position, in which the door can be fully closed. When the lower dish rack of the dishwasher in particular for example is moved forward for loading or unloading dishes or other items to be washed, it generally rests on the inner face of the door, which is opened into a roughly horizontal position, with the result that the abovementioned display facility is covered. This is of course also the case when the upper dish rack is pulled forward out of the wash compartment into its loading/unloading position.

When the door is pivoted downward into a horizontal open position to load the wash compartment, the display facility is then a long way down and cannot be seen easily or even read from above by an operator even without being covered by the one or more dish racks, so that generally the loading or unloading operation is first completed and the door is then closed at least partially so the display can be read. However this is inconvenient. If once the display has been examined it is necessary to reorganize the contents of the wash compartment, the door has to be opened fully again and at least one wash rack has to be pulled out forward again. Users frequently find this a nuisance and are unwilling to do it.

The problem underlying the invention is that of making it easier for the user to see output display values of the dishwasher and to facilitate optimizing intervention in the parameters of a wash process.

BRIEF SUMMARY OF THE INVENTION

The invention resolves this problem by means of a dishwasher with the features of claim 1.

The inventive assignment of at least one display facility to a wash rack facilitates the examination of the display output by the machine and allows it to be performed easily without even only partially closing the door as the machine is being loaded. It is thus possible to respond to the displayed information before closing the door—regardless of its specific configuration—and while loading, for example by moving items to be washed from one dish rack to another or taking them out again, if for example the visual display facility on at least one dish rack conveys data relating for example to a wash rack weight loading, thereby outputting in particular that the loading is very uneven between a number of dish racks.

Weight can be determined in a structurally simple and reliable manner in particular by way of pressure-sensitive piezo arrangements within the roller paths of the at least one dish rack.

In so far as the visual display facility supplies information about an intended program sequence, for example a wash duration, it is possible to shorten the wash duration by removing individual heavy or particularly large items, if this appears better to the user for the current wash cycle.

The at least one visual display facility can also be used for example to convey data about the stock of operating agents provided, for example dishwasher salt or other washing agents, so that it is possible to top up cleaning agents directly on the inner face of the door after loading while the door is still open, being pivoted down for example.

It is possible in particular to provide a number of dish racks one on top of the other, so that redistribution between these can also optimize a program sequence. A visual display facility can also be assigned individually to each dish rack here, taking into account the loading weight of each dish rack individually in each instance.

The or each visual display facility advantageously comprises a field for alphanumeric displays, so that more complex instructions such as "redistribute items from top to bottom" or "rinse aid low" or the like can be notified to the user during loading.

So that it can be read particularly easily the or each visual display facility is assigned to a front (in the case of a front door) region of a dish rack facing a door, in particular a front defining plane of the respective dish rack projecting more or less vertically, for example within a pull/push handle assigned to the front defining plane of the respective dish rack.

To keep production costs low, the at least one visual display facility can preferably be controlled wirelessly, for example by radio or optical signal transmission, so that there is no need for cables for the data stream.

There is in particular no need for any cabling for the display facility if it is provided with its own voltage supply. To save energy the display of data by way of the or each visual display facility is expediently coupled to the state of opening of the door and the display facility is switched off when the door is closed.

An operating element can optionally also be disposed in direct proximity to the visual display facility, for example together with it on a pull and/or push handle for the respective dish rack, so that it is possible to respond to the displayed information immediately—and even before closing the door—for example by changing the program selection.

Other advantageous developments of the invention are set out in the subclaims.

BRIEF DESCRIPTION OF THE DRAWINGS

The invention and its developments as well as their advantages are described in more detail below with reference to drawings, in which.

DETAILED DESCRIPTION OF EXEMPLARY EMBODIMENTS OF THE PRESENT INVENTION

Figure 1:
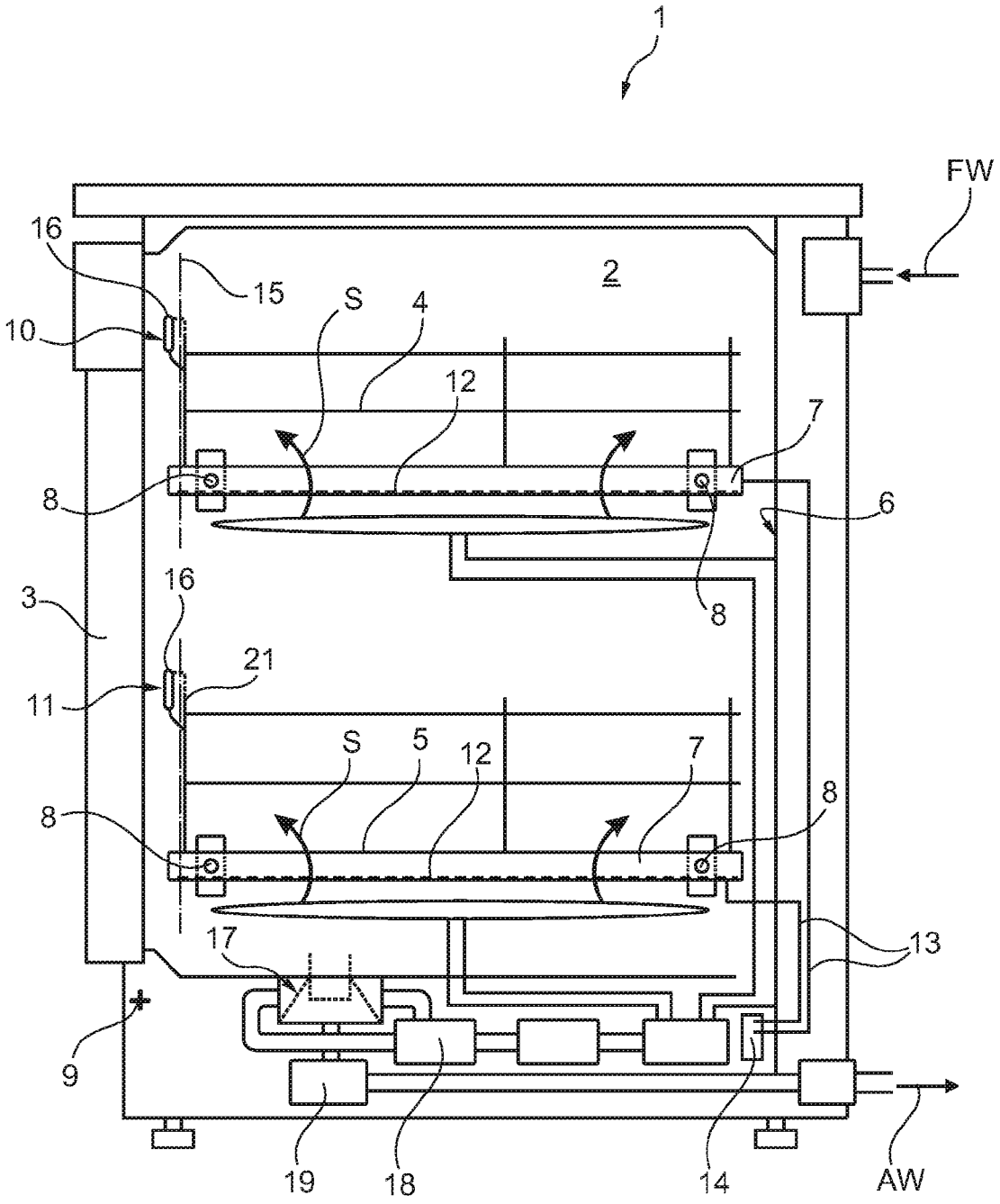
FIG. 1 shows a schematic diagram of a side view of a dishwasher looking into the wash compartment with the front door closed and with two dish racks disposed one above the other, to which visual display facilities are assigned in handle regions according to one advantageous variant of the invention.

Elements with identical function and mode of operation are assigned identical reference characters in all the figures.

The dishwasher 1 illustrated in FIG. 1 is a household dishwasher and features wash compartment 2 which in particular can be closed off by a front door 3—although a top lid can also serve as the door 3—to receive items to be washed, such as dishes, pots, cutlery, glasses, cooking utensils and the like. These can be supported in at least one movable dish rack 4, 5; in this instance two dish racks 4, 5 are provided one above the other in the wash compartment 2, but this is not essential. The dish racks 4, 5 here can be subjected to the action of water or water containing cleaning agent, rinse aid and/or other additional substances, in other words generally speaking what is known was wash liquor S, in each instance with an upward component, by way of two rotatably supported spray arms or one or more other spray facilities.

The lower dish rack 5 can be configured in such a manner that larger items such as pans, pots or sheet pans can be held in it, in particular so that their inner or upper face faces downward. Any burned-on regions can then be reached from below and processed with wash liquor S, so that any burned on residues or other significant soiling can be removed.

The dishwasher 1 further comprises a supply facility for fresh water FW, by way of which fresh water FW supplied from outside can be introduced into the wash compartment 2. The water from the wash compartment 2 collects due to gravity as wash liquor S in a sump present in the lower part of the wash compartment 2 as a depression in its base. A filter facility 17 may also be present here.

Downstream of the sump is a circulation pump 18, which can be used to pump the wash liquor S out of the sump by way of a heater to a distribution chamber during a circulation phase of a wash cycle, so that it can be reintroduced into the spray arms.

In order in contrast to be able to discharge wash liquor S that is no longer needed out of the wash compartment 2, a drain pump 19 is also provided, which is connected to the sump on the suction side and to a waste water connection line on the output side. The drain pump 19 allows wash liquor S to be pumped to the outside as waste water AW during a discharge phase of a wash cycle.

When the door 3 is in the closed end position the or each dish rack 4, 5 is in a treatment or processing position in proximity to a rear wall 6 of the wash compartment 2 opposite the closed door 3. For simple loading and unloading the at least one dish rack 4, 5 can be moved into an access position that facilitates loading and unloading with a forward component—away from the rear wall 6—when the door 3 is open. Rails 7 positioned at the sides for example are provided for this purpose, it being possible to displace the dish racks 4, 5 horizontally by way of rollers 8 on these.

When the at least one dish rack 4, 5 is moved forward into the access position, the door 3 shown is pivoted down at the front about a horizontal transverse axis 9 and is essentially horizontal so that the dish racks 4, 5 are then positioned above the plane of extension of the open door 3.

The dishwasher 1 further comprises at least one display facility 10, 11 for the visual notification of dishwasher operation and/or program information. At least one of these display facilities 10, 11 here is assigned to a dish rack 4, 5 and can therefore be read easily even when the door 3 is open. Each of the two dish racks 4, 5 here has its own display facility 10 and 11 respectively, so that for example the current loading weight of each dish rack 4, 5 can be displayed directly thereon. Independently of this at least one further display option may also be provided on the door 3 or on another front housing region.

The respective display facility 10, 11, which is provided directly on the respective dish rack 4, 5, should however also be easy to see during loading or unloading of the dishwasher 1 when the door 3 is still open—in particular when looking down from above—so that it is possible to respond to the data displayed there immediately and even before setting and starting a wash program.

According to the exemplary embodiment the weight of each dish rack 4, 5 is determined, to which end piezo arrangements 12 for example may be provided, which can be disposed on the rails 7 and can respond in a pressure-sensitive manner to the rollers supporting the dish racks 4, 5. The visual display facility 10, 11 can then convey the detected data about a weight loading of at least one dish rack 4, 5 to the user. It may also be possible to detect the volume and additionally the type of dishes placed therein.

The detected weight data can be routed on the one hand for example by way of cable 13 to a central control unit 14 and at the same time for example by way of a wireless transmission to the display facility/ies 10, 11. These display facilities are therefore connected directly to the central control unit 14. This can be disposed for example in the base region or even in the door 3, for example adjacent to or on a container 22 for receiving washing agent or cleaning agent, rinse aid and/or other additional agents in the door, so that the display facilities 10, 11, which are then in a direct free line obliquely above, can be radioed from there or can be supplied with information about the loading state in another wireless manner, for example optically, in particular by means of infrared beams.

Additionally or alternatively the visual display facility 10, 11 can also convey data about an intended program sequence, for example the duration of the wash program as a function of the weight loading of the dish racks 4, 5. The user can respond to this immediately, for example by removing particularly heavy items from the wash compartment 2 to speed up the wash program, for example if there is a time by which said user wishes the wash program to be completed. A response can also take place by way of adjacent operating units 20, for example by setting a wash program that takes into account the high loading level.

The at least one visual display facility 10, 11 can likewise also convey data about the stock of operating agents introduced, e.g. cleaning agents, rinse aid and/or other additional agents, e.g. dishwasher salt and/or other washing agents. It is also particularly practical for this purpose to be able to respond to any shortage of operating agents when the door 3 is still open, as such agents have to be topped up in a container 22 on the inside of the door 3 or another wall of the wash compartment 2. If the information were not displayed to the customer until the door 3 was closed, said customer would have to open it again to top up, which is not very convenient.

The options for the visual display facility 10, 11 can also output quite direct instructions for optimizing a program sequence, for example so that if the weight loading of the dish racks 4, 5 is uneven, the advice is output to move items from one dish rack to the other.

Particularly detailed displays are possible if the or each visual display facility 10, 11 comprises a field for alphanumeric displays, in which text messages can also be output in various preselectable languages.

Data relating to the volume of the introduced items to be washed can also be detected and displayed, being determined for example by way of light barriers. Here too it may be advantageous to switch between the dish racks 4, 5 to optimize a program sequence, being prompted to do so by the display facilities 10, 11 by way of corresponding messages.

An LED display may also suffice for simple information, in which for example a first row of LEDs indicates a measure of the weight according to the number of light-emitting diodes and a second row of LEDs indicates a measure of operating agents still present, e.g. cleaning agents, rinse aid and/or water softeners. In particular the respective display facility may be configured so that the loading quantity or at least one other parameter can be displayed digitally.

As shown here in the drawing, the or each visual display facility 10, 11 is in particular assigned to a front region of a respective dish rack 4, 5 facing the door 3 in its closed position, so that it is particularly easy to read. According to the drawing the visual display facilities 10, 11 have a roughly vertical installation position and are attached at the front in each instance to projecting front defining planes 15 of the respective dish rack 4, 5. Such attachment can also be detachable, for example by way of a clip connection, to allow simple replacement and so that the display facility 10, 11 can also be positioned at different points on the dish rack 4, 5, for example also on its rear plane.

Figure 2:
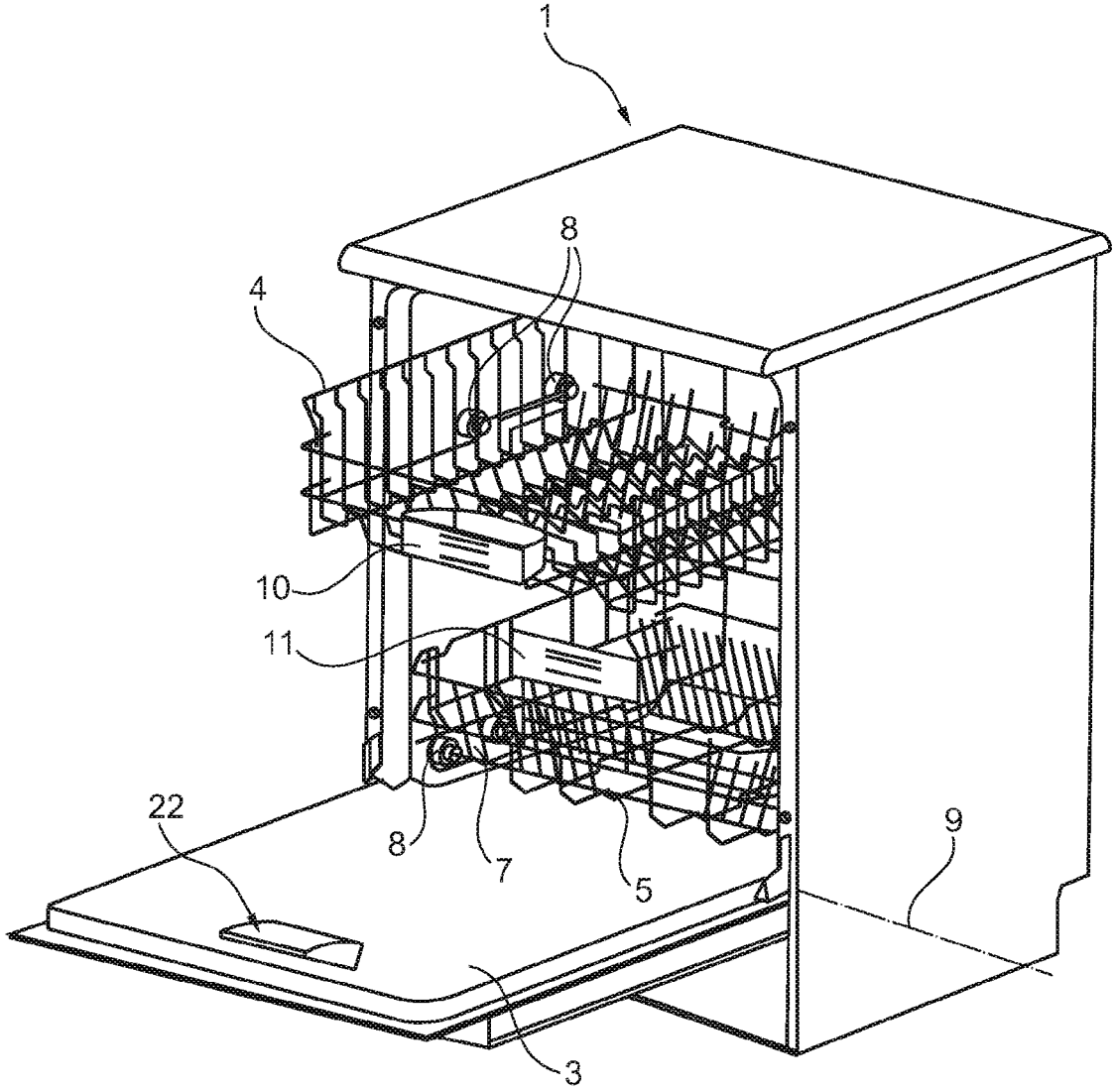
FIG. 2 shows a perspective view obliquely from the front of a dishwasher like the one in FIG. 1 with the door pivoted downward.
Figure 3:
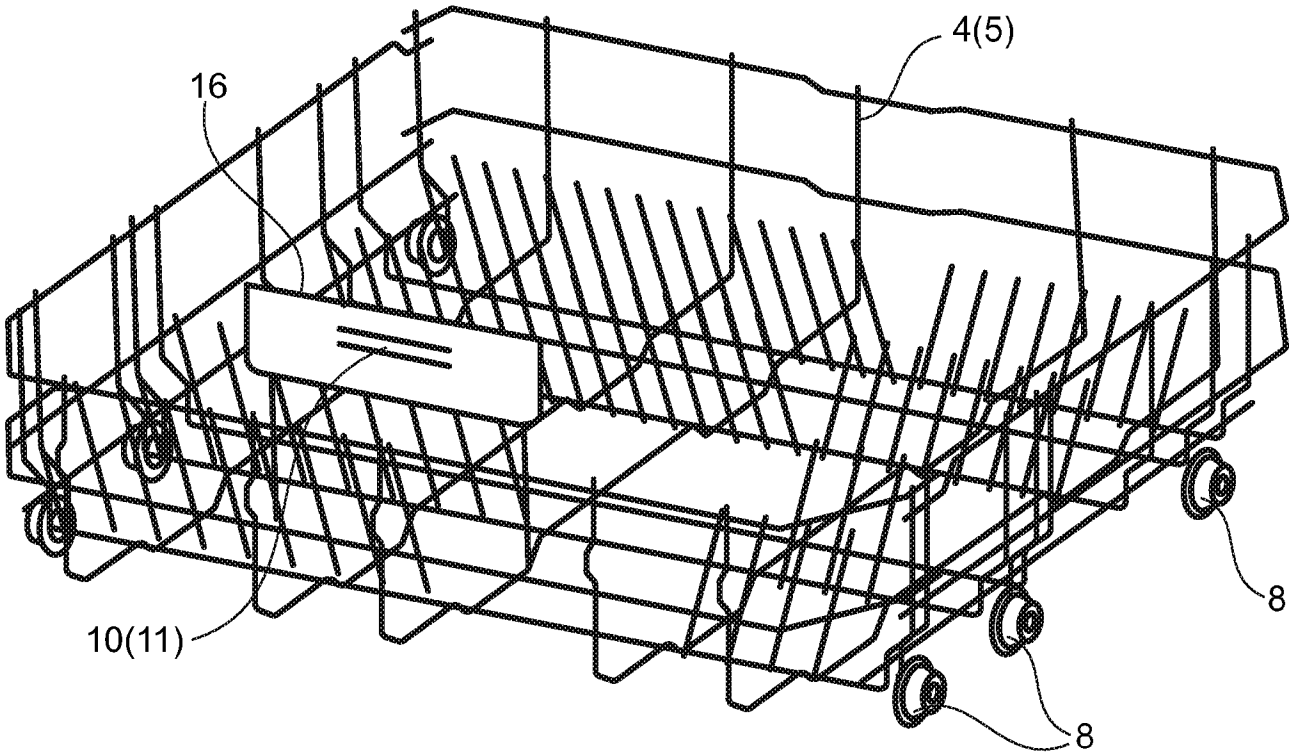
FIG. 3 shows a perspective view obliquely from the front of a dish rack with a visual display facility.
Figure 4:
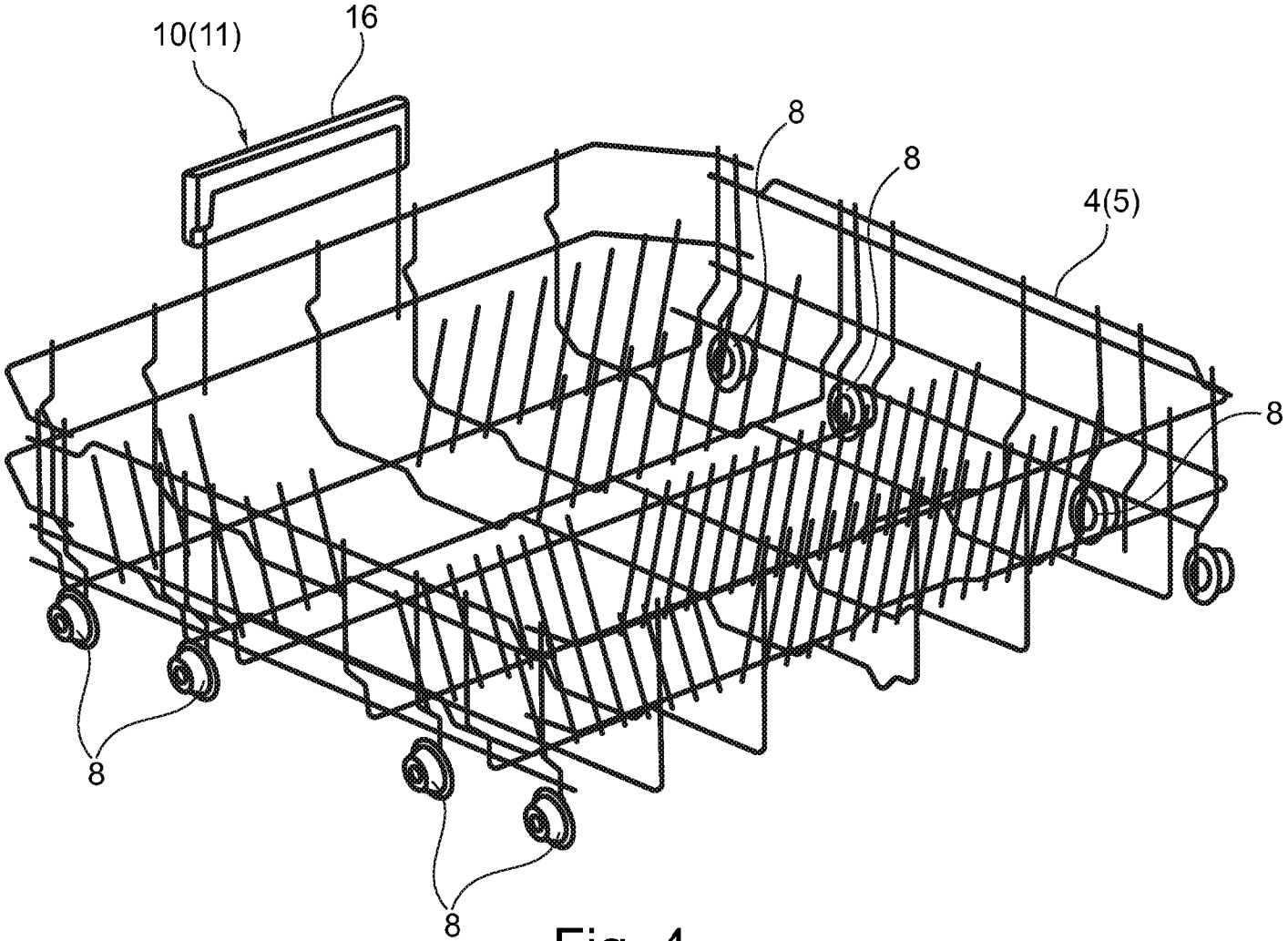
FIG. 4 shows the dish rack from FIG. 3 viewed obliquely from the rear.
Figure 5:
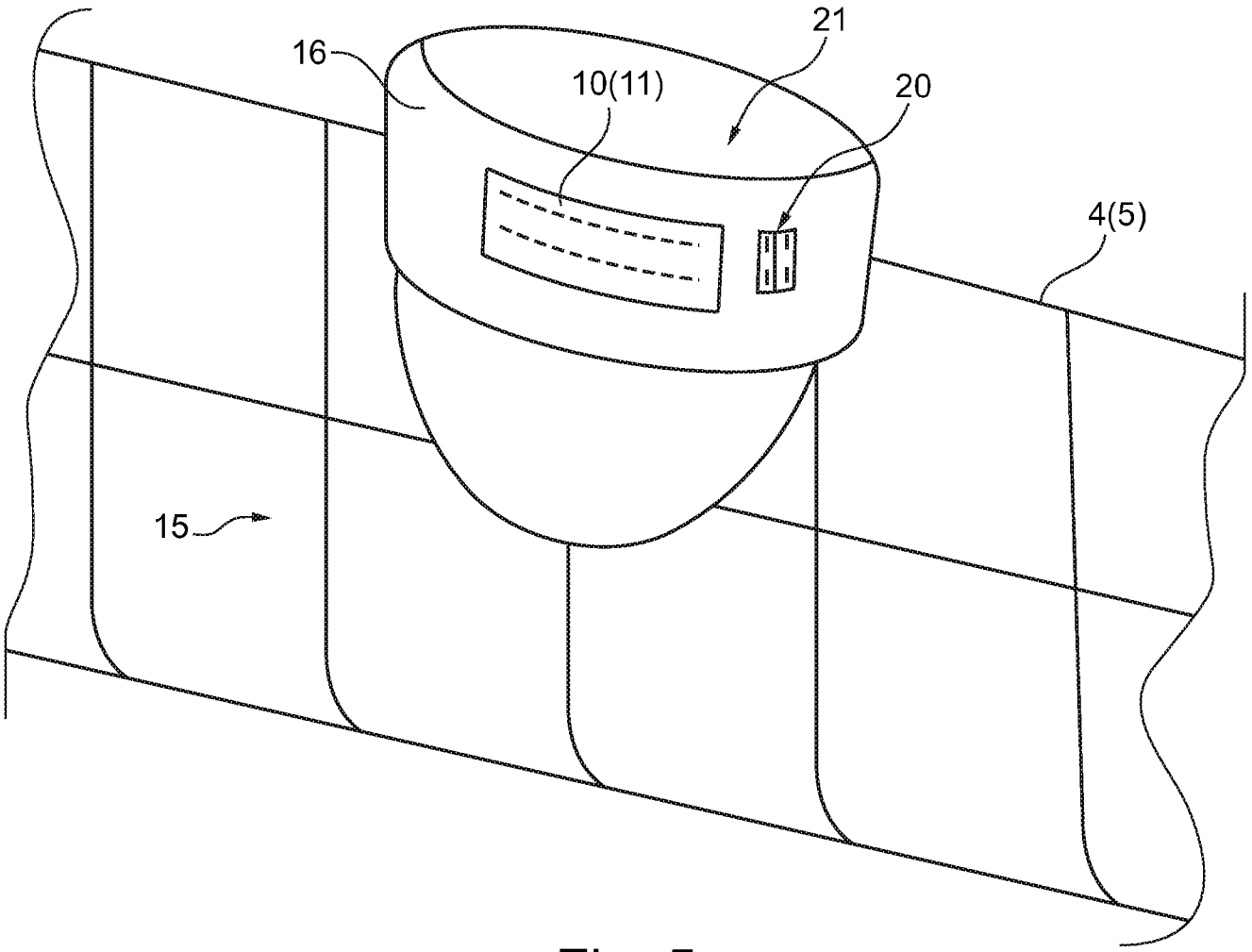
FIG. 5 shows an enlargement of the front region of a dish rack with a visual display facility and an operating element located adjacent thereto on a pull/push handle in front of a handle shell.

In one very elegant solution the or each visual display facility 10, 11 is disposed integrally within a pull/push handle 16 assigned to the front defining plane 15 of the respective dish rack 4, 5, it being possible for said pull/push handle 16 to be located transversely in front of a handle shell 21 as in FIG. 5. Such a handle shell 21 can also be seen on the upper dish rack 4 in FIG. 2. In a simpler instance a simple plate (FIG. 3) or tubular piece can also form a handle 16. Also one or more operating elements 20 can be provided on the handle 16, for example push buttons or rotary switches, which are then located in direct proximity to the visual display facility 10, 11 and allow a direct response to the displayed data.

In each instance the visual display facility 10, 11 is configured as watertight, for example by being molded into a sealed unit, which can be inserted as a whole into the pull/push handle 16.

In particular if the data is transmitted wirelessly to the at least one visual display facility 10, it is particularly useful also to be able to dispense with cables for its energy supply and to provide the or each visual display facility 10, 11 with its own voltage supply, for example by way of a replaceable or permanent battery.

In order to save energy and to achieve a long service life even when using a battery, the data display by way of the or each visual display facility 10, 11 can be coupled to the state of opening of the door 3 and the display facility 10, 11 can be switched off completely when the door 3 is closed. A phototransistor positioned on the display facility 10, 11 can be used for example to detect the state of the door, switching off the display when it is dark (door 3 closed). This phototransistor can also be used to transfer data to the respective visual display facility 10, 11. In general terms the data transmission between the control device of the dishwasher and the respective display facility on the respective dish rack can take place wirelessly, e.g. by way of a radio or optical interface. An optical interface/sight connection can be expedient particularly when the display facilities, in particular the rack handles with the display facilities, of the upper and/or lower dish rack are roughly at the same height, when the door is in its closed end position, as the dispensing or dosing unit for dosing in treatment agents, e.g. cleaning agents, rinse aid and/or additional agents, which is connected to the control device of the dishwasher by way of at least one electric line. This allows a direct coupling of optical signals along a free connecting line between an optical transmit element on or in the door and an optical receive element on the respective dish rack. This of course applies similarly for any other wireless communication.

It is likewise possible to switch off the display facility 10, 11 automatically after a stipulated maximum time period in order to save energy.

Instead of a wireless data connection the respective display facility on the respective dish rack can be coupled to the control device of the dishwasher by way of at least one electric and/or optical data line or other electrical and/or optical contacts.

In general terms the respective dish rack of the inventively configured dishwasher is itself provided with at least one display facility which can be used to display one or more state parameters, e.g. the loading weight of the items in the dish rack, the type of items to be washed, the degree of soiling of the items to be cleaned, etc., to a user when the door is open, in particular in its horizontal open end position, along a free line of sight largely unobstructed. The display facility here can be attached in any position on the respective dish rack that is clearly visible to a user when the door is in an open position, in particular its horizontal open position. This can in particular be the front defining plane of the respective dish rack. Additionally or independently of this however a display facility may also be expedient on the rear defining plane of the respective dish rack facing the wash compartment rear wall, as in the loading/unloading end position of the dish rack, in which this is pulled frontally forward largely completely out of the wash compartment in respect of its depthwise extension, it is particularly clearly in the field of vision of a user, who is bending down over the drawn out dish rack. Of course according to a further advantageous variant of the invention the display facility can also be attached roughly in the center of the respective dish rack in respect of its depthwise extension, so that it is not covered and is therefore also visible from above when the dish rack is drawn out to the half-open position.

In particular the respective display facility can also in some instances be configured as a loose component. It can in particular be configured so that it can be attached in such a manner that it can be clamped onto one or more wires of the dish rack so that it can be detached again with the fingers.

What is claimed is:

1. A dishwasher, comprising:

a door;

a wash compartment that is closed off by the door, the wash compartment to receive items to be treated and the wash compartment having a movable dish rack in which items to be cleaned are supported and that is moved from a treatment position in which the wash compartment is closed to an access position in which loading and unloading of dishes into the dishwasher is facilitated; and a visual display facility for conveying electronic data and visual notification of at least one of operation information and program information of the dishwasher;

wherein the visual display facility is disposed on or integrated with the dish rack.

2. The dishwasher of claim 1, wherein the dishwasher is a household dishwasher.

3. The dishwasher of claim 1, wherein the visual display facility conveys data about at least one of a load state and a load type of the dish rack.

4. The dishwasher of claim 3, wherein the data are weight loading data.

5. The dishwasher of claim 3, further comprising a plurality of pressure-sensitive piezo arrangements to determine a weight.

6. The dishwasher of claim 1, wherein the visual display facility conveys data about an intended program sequence.

7. The dishwasher of claim 1, wherein the visual display facility conveys data about a stock of provided operating agents.

8. The dishwasher of claim 7, wherein the provided operating agents include a dishwasher salt.

9. The dishwasher of claim 7, wherein the provided operating agents include washing agents.

10. The dishwasher of claim 1, wherein the visual display facility outputs instructions for optimizing a program sequence.

11. The dishwasher of claim 1, further comprising a plurality of dish racks that are arranged one above the other.

12. The dishwasher of claim 11, wherein a respective visual display facility is assigned to each of the plurality of dish racks.

13. The dishwasher of claim 12, wherein the respective visual display facility has a field for alphanumeric displays.

14. The dishwasher of claim 1, wherein the visual display facility is assigned to a region of the dish rack facing the door.

15. The dishwasher of claim 11, wherein a respective visual display facility is assigned to a front plane of each of the plurality of dish racks.

16. The dishwasher of claim 15, wherein the respective visual display facility is disposed within a pull/push handle assigned to the projecting front defining plane of each of the plurality of dish racks.

17. The dishwasher of claim 1, wherein the visual display facility receives display data in a wireless manner.

18. The dishwasher of claim 1, further comprising a voltage supply for the visual display facility.

19. The dishwasher of claim 1, wherein the visual display facility is switched off when the door is closed.

20. The dishwasher of claim 1, wherein an operating element is disposed adjacent to the visual display facility on the dish rack.

* * * * *